US006244082B1

(12) United States Patent
Avganim

(10) Patent No.: US 6,244,082 B1
(45) Date of Patent: Jun. 12, 2001

(54) PORTABLE COMPUTERS LOCK

(76) Inventor: Meir Avganim, Moshav 156, 76885 Gealiya (IL)

( * ) Notice: Subject to any disclaimer, the term of this patent is extended or adjusted under 35 U.S.C. 154(b) by 0 days.

(21) Appl. No.: 09/355,850

(22) PCT Filed: Jan. 26, 1998

(86) PCT No.: PCT/IL98/00039

§ 371 Date: May 18, 1999

§ 102(e) Date: May 18, 1999

(87) PCT Pub. No.: WO98/32939

PCT Pub. Date: Jul. 30, 1998

(30) Foreign Application Priority Data

Jan. 28, 1997 (IL) ..... 120090

(51) Int. Cl.[7] ..... E05B 69/00
(52) U.S. Cl. ..... 70/58; 70/14; 70/57
(58) Field of Search ..... 70/58.57, 18, 14

(56) References Cited

U.S. PATENT DOCUMENTS

| | | | | |
|---|---|---|---|---|
| 4,055,973 | | 11/1977 | Best . | |
| 4,305,266 | * | 12/1981 | Luckwood | 70/58 |
| 4,328,687 | | 5/1982 | Ritchie . | |
| 5,127,244 | | 7/1992 | Myers . | |
| 5,345,794 | | 9/1994 | Jenks . | |
| 5,447,044 | | 9/1995 | Cheng . | |
| 5,502,989 | | 4/1996 | Murray, Jr. | 70/58 |
| 5,579,657 | | 12/1996 | Makous . | |
| 5,623,842 | | 4/1997 | Davidge . | |
| 5,676,258 | | 10/1997 | Leyden et al. . | |
| 5,709,110 | * | 1/1998 | Greenfield et al. | 70/58 |
| 6,000,251 | * | 12/1999 | Murray, Jr. et al. | 70/58 |
| 6,006,557 | | 12/1999 | Carl | 70/58 |
| 6,105,922 | * | 8/2000 | Derman | 70/58 X |

* cited by examiner

*Primary Examiner*—Teri Pham Luu
(74) *Attorney, Agent, or Firm*—Ostrolenk, Faber, Gerb & Soffen, LLP

(57) ABSTRACT

A locking arrangement for securing portable computers and the like against theft including a cable (40) with a cable head (36) extended by a first stem portion (42), a collar portion (38) and a free end second stem portion (44) all in axial alignment. A prismatic lock body (10) includes a push-in, keyoperated locking device (24) having a releasable locking detent (26'). The body (14) has front (12), rear (18) and two side surfaces (14; 16). First, second and third bores (30; 32; 34) are formed respectively at the front and two side surfaces, in a common plane, passing each other and being of a diameter slightly larger than that of the collar portion (38). The locking detent (26') is insertable behind the collar (38) and above the first stem portion (42) thus precluding the extraction of the cable head (36) when inserted into any of the bores. Also, the rear side surface of the lock body can be secured to a portion of the computer, e.g., by gluing. For securing originally slot equipped computers (122), the arrangement further includes a standard T-shaped spindle head (154), configured to fit into the slot (150) in one position and to prevent removal upon being rotated within the slot after stem (44) is also inserted into the slot.

10 Claims, 2 Drawing Sheets

PORTABLE COMPUTERS LOCK

BACKGROUND OF THE INVENTION

This invention relates to locking devices, particularly of the kind known as lap-top or portable computers anti-theft locks.

Most models of portable computers are equipped by the manufacturers with safety means, usually including a standardized dedicated slot in one of their walls. A variety of locking devices with extension steel cables have been developed for the easy but safe attachment and the disengagement thereof to such slots, based on a T-shaped spindle and tumbler design—see for example U.S. Pat. No. 5,327,752 (To Myers et al.)

These however suffered numerous disadvantages, among others, the need for a separate key, or memorizing a combination code; need for ancillary parts, in the absence of an existing slot; non-rotatability of the cable (which causes a nuisance to the user); or complicated and expensive structures.

The invention aims to overcome many of the deficiencies of the conventional arrangements, and to provide a unified and compact locking arrangement equally applicable to both slotted and non-slotted structures.

SUMMARY OF THE INVENTION

The invention thus provides for a locking arrangement for securing portable computers and the like against theft, comprising a cable with a cable head extended by a first stem portion, a collar portion and a free end second stem portion all in axial alignment. A prismatic lock body is provided comprising a push-in, key-operated locking device having a releasable locking detent. The body has front, rear and two side surfaces. First, second and third bores are formed respectively at the front and two side surfaces, in a common plane, passing each other and being of a diameter slightly larger than that of the collar portion. The locking detent is insertable behind the collar and above the first stem portion thus precluding the extraction of the cable head when inserted into any of the bores. Further provided are means for securing the rear side surface of the lock body to a portion of the computer, e.g., by gluing.

For securing the originally slot equipped computers, the arrangement further comprises a standard T-shaped spindle head, configured to fit into the slot in on e position and become precluded from retrieval upon being rotated within the slot. A support plate for the spindle head is provided, attachable to the rear wall of the lock body. The spindle head extends off-centrally relative to the axis of the first bore. A fourth bore is coaxially formed at the rear surface and at the support plate so that upon insertion of the cable head into the first bore, the collar portion becomes so located as to be arrested by the locking detent, and the second stem passes the fourth bore and projects into the slot to prevent the rotation of the spindle head therebehind and the release of the lock body from the computer.

BRIEF DESCRIPTION OF THE DRAWINGS

These and additional features and advantages will be apprehended from the following description of a preferred embodiment of the invention, given by way of example only, wherein.

DETAILED DESCRIPTION OF THE PREFERRED EMBODIMENTS

Figure 1:
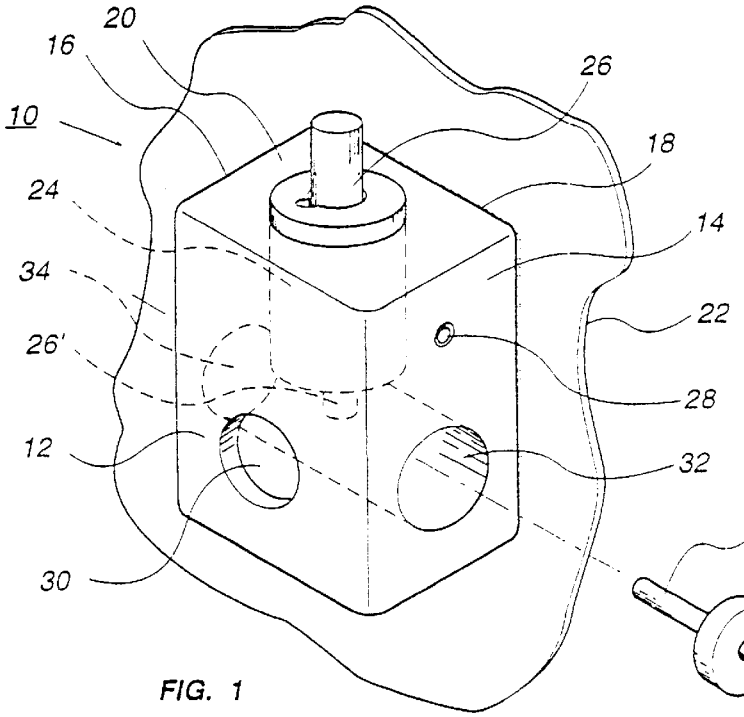
FIG. 1 is perspective view of a lock-body member featuring the teachings of the present invention.
Figure 2:
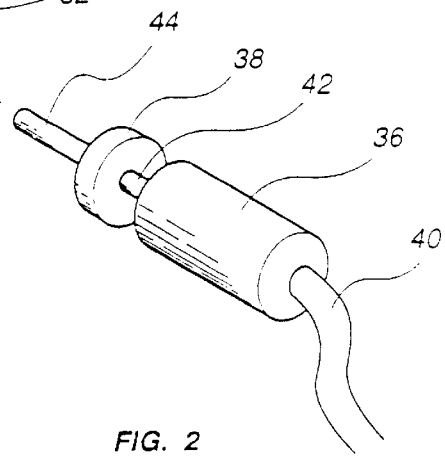
FIG. 2 illustrates a cable head for use in the securement of the lock body of FIG. 1 according to one application.

As seen in FIG. 1 the lock body generally denoted 10 is solid, having a front prismatic shape—in this embodiment of a rectangular cross-section (for reasons to be explained further below). Thus, the lock body 10 comprises surface 12, first and second side surfaces 14 and 16, rear surface 18 (FIG. 4) and top surface 20. The body 10 is affixed by gluing or otherwise at a convenient location on wall 22 of the portable computer, bearing in mind that the computer is not provided with an arresting slot, as will be described later on.

Figure 3:
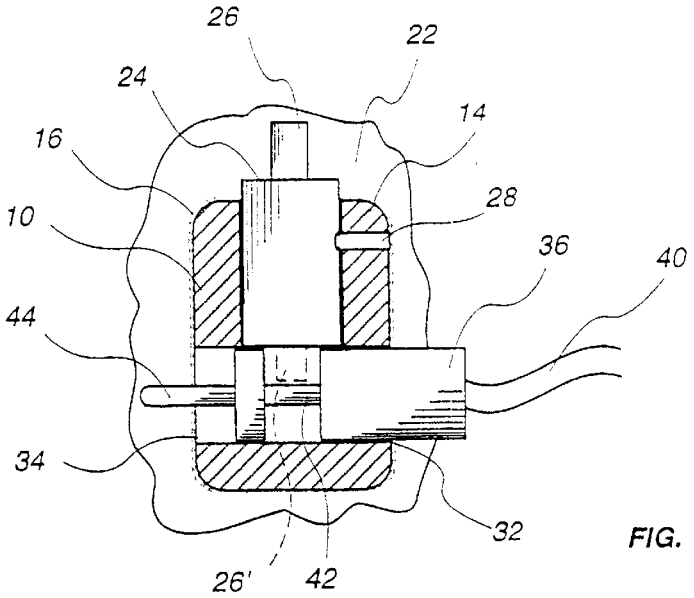
FIG. 3 is longitudinal cross-section of the body member of FIG. 1 with the cable-head of FIG. 2 locked therein.

As better seen in FIG. 3, a standard push-in lock 24 with push button 26 is fixed into the body 10 and secured in the usual manner, as by a pin 28.

As further relevant to the instant embodiment of the invention there are provided in the solid lock body 10 a first bore 30, a second bore 32 and a third bore 34. The axes of the three bores lie in a common plane. The bores are of equal diameters, slightly larger than the diameter of cable head 36 (and collar 38).

Computer arresting cable 40 is affixed to the cable head 36, which is extended by a first stem 42, collar 38, and a second stem 44.

As clearly depicted in FIG. 3, the arresting of the computer wall 22 to the cable 40 is accomplished by inserting the cable head and collar into either of bores 32 or 34, till the stem 42 becomes located underside the push-in lock 24. When the lock is operated, detent 26' projects downwards between the cable head 36 and the collar 38, thereby preventing removal of the cable head 36 from the bore 32 (or 34).

Figure 4:
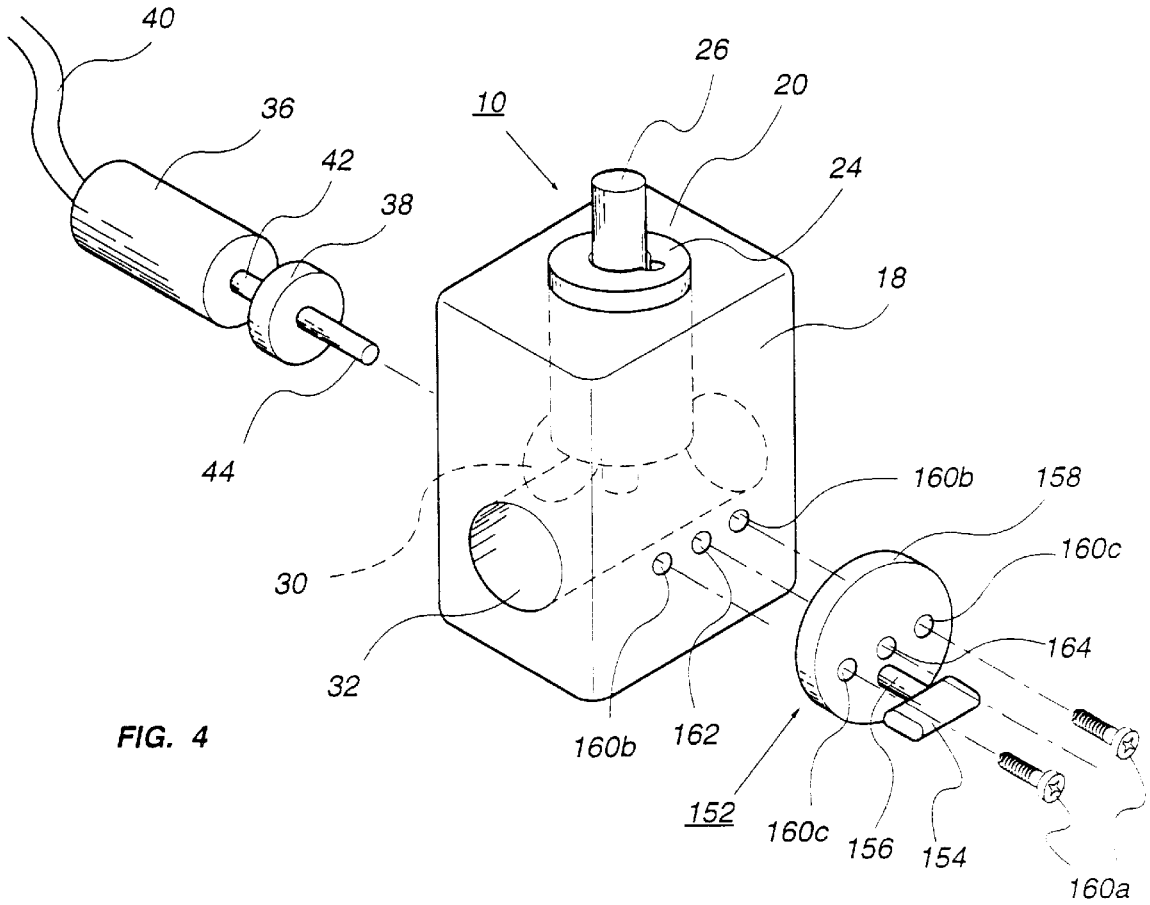
FIG. 4 is another perspective view of the lock-body of FIG. 1, illustrating the mounting of a slot engaging spindle.
Figure 5:
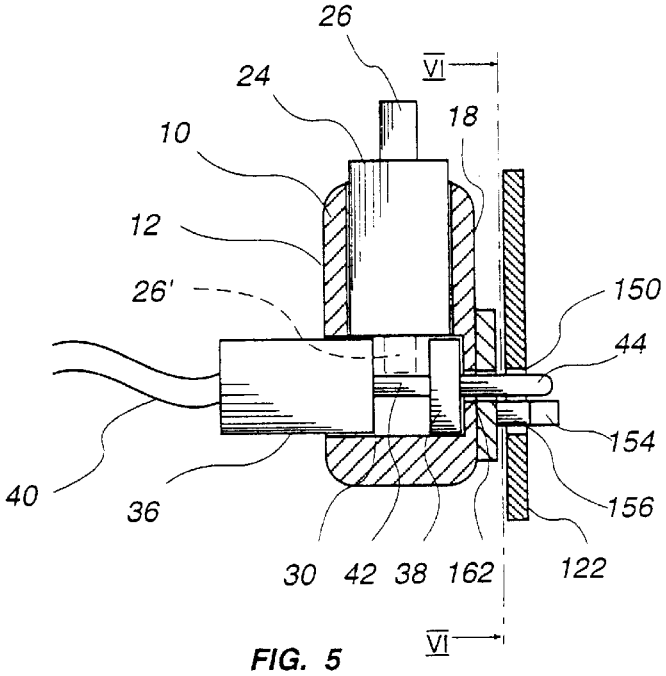
FIG. 5 is a sectional view of the locking arrangement coupled to a slotted wall portion, and FIG. 6 a view taken along line VI—VI of FIG. 5.
Figure 6:
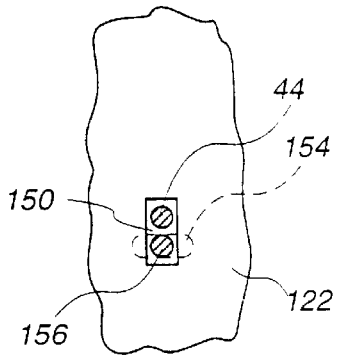

Should the computer wall 122 (see FIGS. 5 and 6) be originally equipped with a standard locking slot 150, the arrangement of FIG. 4 will be utilized. Hence, lock body 10 is supplied to the customers in a kit form with a T-shaped spindle locking member denoted 152 which comprises an elongated double key-shaped head 154 mounted to stem 156 which is integrally or separately formed with support plate 158. The support plate 158 is mountable to the rear wall 18 of the body 10 by a pair of screws **160*a* adapted to be threaded into tapped bores 160*b***.

The rear surface 18 is further provided with a through-going bore 162, of a diameter slightly larger than that of the second stem 44. Upon mounting, the bore 162 becomes aligned with a similar bore 164 made in the support plate 158. As better seen in FIG. 6, the location of the spindle 156 is off-centered relative to the support plate bore 164.

The mounting of the lock body 10 on the slotted computer wall 122 is such that the spindle head 154 is first inserted into the slot 150 when the body 10 is turned 90° in one or other direction. After repositioning the lock body 10 in vertical direction, the spindle head 154 becomes located behind the slot 150 and arrested therein. Final securement of the lock body 10 is now completed by inserting the cable head 36 into the front side bore 30 so that the second stem 44 passes through the bores 162 and 164, and projects into the slot 150, while the collar 38 is trapped by the locking detent 26' of the push-in lock 24 in the same manner as described above with respect to the first usage procedure. Thus, the cable head completes the double functioning of avoiding the rotation of the body lock 10 for releasing same from the protected article, as well as to secure the cable 40 against removal thereof.

It will be now evident that, as an article of manufacture, the combination or set comprising the headed cable, lock body, and mountable spindle successfully fulfill the double function of securing computers in both cases, namely equipped or not-equipped with the standardized designated locking slot.

It will be further understood that the length of the stem 44 is so designed as to project from the back of the body lock and into the slot 150 only for the second mode of use, whereas it is non-functional in the first usage mode. This is the reason for choosing the rectangular prismatic shape of the lock body 10. However other suitable geometrical shapes may of course be selected.

The computer arresting arrangement thus provided is extremely simple and easy to use as compared to parallel known devices, besides being universal in the sense that it fits both possibilities as above described Various changes and modifications will be readily appreciated.

What is claimed is:

1. An arrangement for securing an object, comprising:

A. a cable having a cable head, a first stem portion extending out from the cable head, a collar portion at the first stem portion spaced and away from the cable head, and a second stem portion extending out from the collar portion;

B. a prismatic lock body comprising:

(i) a locking detent, a push button operable by a user for setting the locking detent in a locking position, (ii) front, rear and two side surfaces;

(iii) first, second and third bores formed respectively at the front and two side surfaces, the bores having respective axes in a common plane, and each bore having a cross-section slightly larger than a cross-section of the collar portion, so that the locking detent is insertable between the collar and the cable head and above the first stem portion upon operation of the push button for thus precluding extraction of the cable head from one of the bores when the cable head is inserted into the one bore and (iv) a fourth bore formed at the rear surface of the lock body, the fourth bore being so placed that upon insertion of the cable head into the first bore, the collar portion becomes so located that the locking detent may set in the locking position between the cable head and the collar portion, and the second stem portion passes through the fourth bore and projects from the lock body to interact with a structure on the object to secure the lock body to the object.

2. The arrangement of claim 1, further comprising an adhesive layer spread on the rear side surface of the lock body for securing the lock body to the object.

3. In combination, the arrangement of claim 1, and an object having a housing and the housing is provided with a slot, the arrangement further comprising:

C. (i) a T-shaped spindle head configured to fit into the slot in one position of the spindle head and to prevent removal of the spindle head from the slot upon the spindle head being rotated by less than 180° from the one position;

(ii) a support plate for the spindle head;

(iii) means for fastening the support plate to the rear side surface of the lock body at a location so that the spindle head is extended off-centrally relative to the axis of the first bore, (iv) a fifth bore formed in the support plate and corresponding in shape and size to align with the fourth bore. so that upon inserting the cable head into the first bore, the second stem portion passes through both of the fourth bore and the fifth bore in the support plate to project into the slot in the housing to prevent rotation of the spindle head therebehind and to prevent release of the lock body from the housing.

4. The arrangement of claim 3, wherein the support plate is releasably attachable to the lock body.

5. The arrangement of claim 4, further comprising screws for mounting the support plate to the rear surface of the lock body.

6. The arrangement of claim 3, wherein the cable head, the collar and the first, second, third and fourth bores are cylindrical.

7. The arrangement of claim 1, wherein the lock body is rectangular.

8. An arrangement for securing an object, wherein the object has a housing formed with a slot, the arrangement comprising:

(a) a cable having a cable head, a first stem portion extending out from the cable head, a collar portion at the first stem portion spaced away from the cable head, and a second stem portion extending out from the collar portion; and (b) a prismatic lock body having front, top and rear surfaces, and further including:

(i) a first bore formed at the front surface extending in the direction of the rear surface and the first bore having a cross-section slightly larger than that of the collar portion;

(ii) a second bore, co-axial with the first bore, formed at the rear surface and having a cross-section slightly larger than that of the second stem portion, so that the cable head is insertable through the first bore to the extent that the second stem passes through and projects from the second bore at the rear surface;

(iii) a push-in locking device having a locking detent mounted to the top surface of the lock body, in the locking position of the device after insertion of the cable head into the first bore, the locking detent becomes located between the collar portion and the cable head to prevent extraction of the cable head from the first bore in the lock body; and (iv) a T-shaped spindle head configured to fit into the slot in one position and to prevent removal of the spindle head from the slot upon the spindle head being rotated by less than 180° from the one position, the T-shaped spindle head being mounted to the rear surface of the lock body at a location so that the spindle head extends off-centrally relative to the axis of the second bore, so that by the succession of inserting the spindle through the slot, rotating the lock body, inserting the second stem portion into the slot and locking the locking device, the object becomes secured to the cable.

9. The arrangement of claim 8, wherein the lock body is rectangular.

10. The arrangement of claim 9, wherein the cable head, the collar and the first and second bores are cylindrical.

* * * * *